US005219437A

United States Patent [19]

Moor et al.

[11] Patent Number: 5,219,437

[45] Date of Patent: Jun. 15, 1993

[54] FABRIC COVERED BOOK COVER

[75] Inventors: Marc L. Moor, Dayton; Jon R. Wyant, Spring Valley, both of Ohio

[73] Assignee: The Mead Corporation, Dayton, Ohio

[21] Appl. No.: 823,309

[22] Filed: Jan. 21, 1992

[51] Int. Cl.[5] ..... B42D 3/02

[52] U.S. Cl. ..... 281/29; 281/30; 281/34; 281/37

[58] Field of Search ..... 281/29, 34, 35

[56] References Cited

U.S. PATENT DOCUMENTS

| | | | |
|---|---|---|---|
| 3,227,474 | 1/1966 | Coniker | 281/31 |
| 3,241,863 | 3/1960 | Paddack | 281/29 |
| 3,572,957 | 3/1971 | Strassberg | 281/29 X |
| 4,174,909 | 11/1979 | Jahn | 402/13 |
| 4,274,659 | 6/1981 | D'Ambrosio | 281/34 |
| 4,280,241 | 7/1981 | Pfaff | 281/29 X |
| 4,301,962 | 11/1981 | Monckton et al. | 229/72 |
| 4,630,843 | 12/1986 | Willat | 281/30 |
| 4,856,817 | 8/1989 | Moor | 281/29 |
| 5,013,068 | 5/1991 | Maldonado | 281/34 X |
| 5,020,828 | 6/1991 | Moor | 281/29 |

*Primary Examiner*—Paul A. Bell

*Attorney, Agent, or Firm*—Thompson, Hine and Flory

[57] ABSTRACT

The invention pertains to a fabric covered book cover having front and back leafboards and a spine wherein both leafboards are covered with a fabric material. One characteristic feature of the book cover is that the spine includes a plurality of longitudinal parallel seams which permit the spin to curl slightly and to fit comfortably in the cupped palm of the hand.

6 Claims, 3 Drawing Sheets

FABRIC COVERED BOOK COVER

BACKGROUND OF THE INVENTION

The present invention relates to a fabric covered book cover having front and back leafboards and a spine wherein both leafboards are covered with a fabric material. One characteristic feature of the book cover is that the spine includes a plurality of longitudinal parallel seams which permit the spine to curl slightly and to fit comfortably in the cupped palm of the hand.

Previously, many binders, notebooks and similar school products were covered with rigid board members having relatively sharp edges to protect the contents contained therein. The rigid board kept papers and other materials unwrinkled and unexposed to elements which could stain or damage the papers or other materials. However, the rigid boards made it difficult to carry the binder when carrying other books and materials, and also provided limited decorative effects. The board members would often press into the skin on the arms when a large number of books and binders were cradled between the arms for carriage which was painful.

Recently, there has been a need to design school products which have decorative covers, and additionally are resilient, durable, reusable, easily carried, etc.

SUMMARY OF THE INVENTION

The invention provides a resilient, durable, fabric-covered book cover which is comfortably carried and provides a unique decorative effect.

The book cover includes an inside surface adjacent the contents of the book cover, and an outside surface opposite the inside surface which comes into contact with the hand when the book cover is carried. In a more preferred embodiment, the fabric material is woven nylon or another synthetic material. The book cover includes two leafboards which are rectangular and formed by first and second stiffening members, each stiffening member when incorporated in the book cover has three outside edges which form the periphery of the cover and one internal edge. The fabric encases the stiffening members which are spaced apart on the fabric. A peripheral seam is located along and immediately outside the outside edges of the stiffening members. A pair of parallel and spaced seams running along and immediately adjacent the internal edges of the stiffening members maintain the position of both stiffening members within the fabric. In a more preferred embodiment, the stiffening member is cardboard, pressed paper or the like. In a more preferred embodiment, a padding member can be positioned between the stiffening member and the fabric in each of the front and back leafboards.

The spine is formed by a portion of fabric which connects the front and back leafboards. The spine includes a plurality of parallel longitudinal seams which enable the spine to curl flexibly such that it is easily cupped in the palm of the hand. In a more preferred embodiment, the spine has a padding member encased therein and the plurality f seams maintain a constant amount of the padding material between each parallel stitched seam and thus prevent the padding member from accumulating unevenly in the spine.

At the periphery of the book cover, a thin reinforcing fabric border may overlap the periphery of the inside and outside surfaces and is stitched into the peripheral seam.

The leafboards preferably have at least one pocket on either the front or back portion of the inside surface which is made of additional fabric material typically similar to the fabric cover. The pocket may be made by stitching the additional fabric material to the inside surface. Depending on the design of the pocket, this additional fabric may be incorporated into one of the peripheral seams discussed above. A pocket may be designed to receive and secure a portion of the front or back cover or support of a member to be retained in the book cover such as a folder(s), notebook(s), 3-ring binder, a book (hard-cover or softback), and the like, or the pocket may be used for storing supplies such as pencils, pens, markers, erasers, paperclips, rubber bands, tape, memo pads, and the like.

In the more preferred embodiment, more than one pocket is created on the inside cover surface. The additional pocket(s) may vary in size. The pocket(s) may have a zipper or closure stitched to its opening to keep the materials stored within.

This invention is useful as a cover for binders, notebooks, books, organizers, folders, and the like.

DEFINITION

Figure 1:
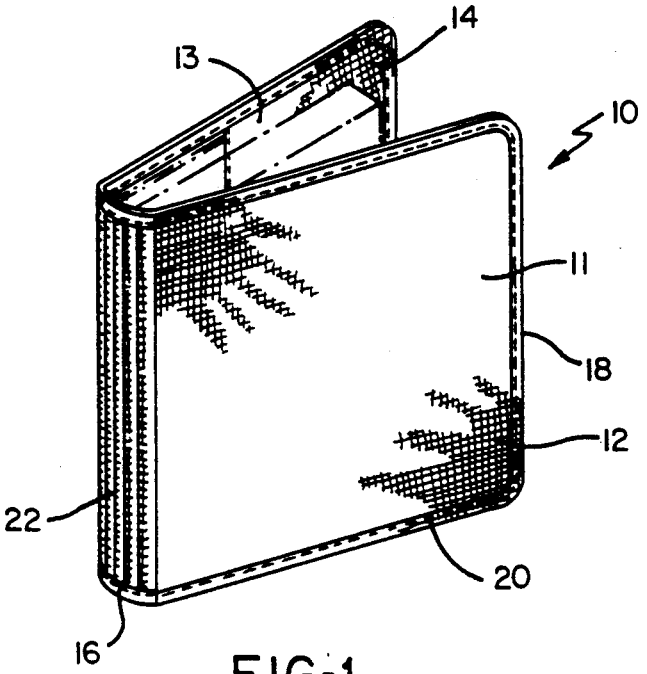
FIG. 1 is a perspective view of a book cover in accordance with the invention.
Figure 2:
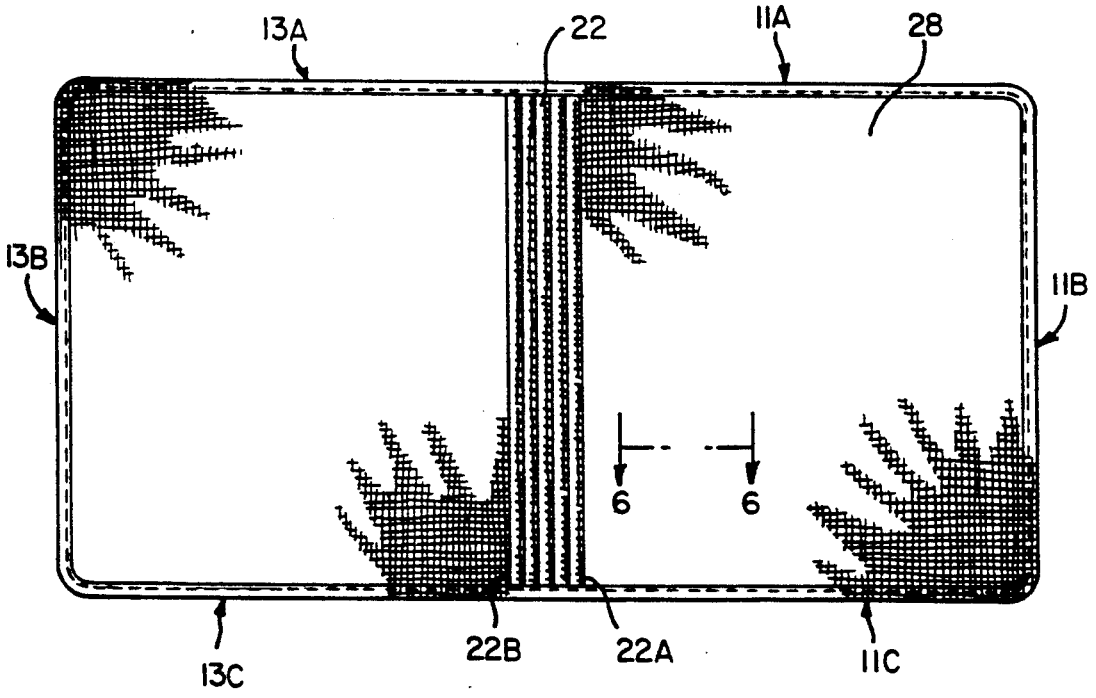
FIG. 2 is an overhead view of the outside surface of a book cover in accordance with the invention.

The term "book cover" as used herein is not limited to covers for books per se but includes covers for binders, notebooks, folders, etc.

DETAILED DESCRIPTION OF THE INVENTION

Referring to FIGS. 1–7, a book cover 10 comprises a front leafboard 11, a back leafboard 13, and a spine 16. The front leafboard comprises three outside edges **11*a*, 11*b* and 11*c* and an internal edge 22*a*. The back leafboard comprises three outside edges 13*a*, 13*b* and 13*c*, and an internal edge 22*b*. The book cover 10 has an inside fabric surface 14 and outside fabric surface 12. In a preferred embodiment, the inside and outside fabric surfaces are woven nylon or another synthetic material. The front leafboard comprises a first stiffening member (not shown) which is about the same size as the front leafboard 11 and is retained immediately inside the three outside edges of the front leafboard 11*a*, 11*b* and 11*c*, and the internal edge 22*a*. The back leafboard 13 comprises a second stiffening member 24 (FIG. 6) which corresponds in size substantially to the back leafboard 13 and is retained immediately inside the three outside edges of the back leafboard 13*a*, 13*b*, and 13*c*, and the internal edge 22*b***. In a preferred embodiment, the stiffening member comprises either cardboard, pressed paper, or the like.

The first and second stiffening members corresponding to each of the front leafboard 11 and the back leafboard 13 are retained between the inside surface fabric 14 and the outside surface fabric 12 by a peripheral seam 20 and inner seams 22*a* and 22*b*. Seam 22*a* is stitched and runs along and immediately outside the internal edge of the first stiffening member. Seam 22*b* is stitched and runs along and immediately outside the internal edge of the second stiffening member 24. The peripheral seam 20 and inner seams 22*a* and 22*b* maintain the position of the first and second stiffening members.

Figure 6:
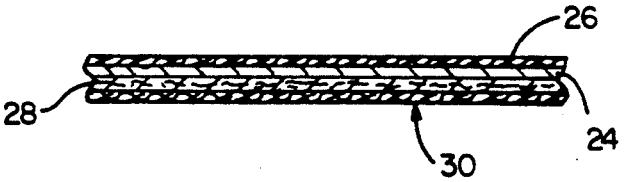
FIG. 6 is a cross-section of the front cover along the line 6—6 in FIG. 2.

In a more preferred embodiment, a padding member 28 is encased within the front leafboard 11 and the back leafboard 13 on the outside surface of each stiffening member. As illustrated in FIG. 6, the padding member 28 is encased between the back stiffening member 24 and the outside fabric surface 30 in the back leafboard 13, and a corresponding construction is provided in the front leafboard 11.

The book cover 10 preferably includes a thin reinforcing fabric border 18 at the periphery of the book cover which overlaps the periphery of the inside fabric surface 14 and outside fabric surface 12. The reinforcing fabric border 18 is stitched into peripheral seam 20 around the periphery of the book cover. In a preferred embodiment, the thin reinforcing fabric border 18 is woven nylon or another synthetic material.

Figure 5:
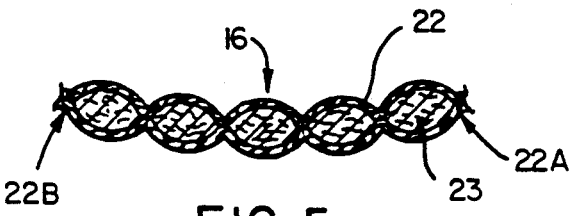
FIG. 5 is a cross-section along the line 5—5 in FIG. 4.

The book cover 10 comprises a fabric spine 16 which connects and separates the front leafboard 11 from the back leafboard 13 and separates the first and second stiffening members. The spine 16 is made by stitching the inside fabric surface 14 and outside fabric surface 12 together with a plurality of longitudinal parallel seams 22. The parallel seams 22*a* and 22*b* are the outer edges of the spine 16. The plurality of parallel seams 22 are preferably . stitched through the inside and outside fabric surface such that there is an equal distance between the adjacent parallel seams. As illustrated in FIG. 5, in a preferred embodiment of the spine 16, a padding member 23 is encased between the inside fabric surface 14 and the outside fabric surface 12. The plurality of parallel seams 22 maintain a constant amount of the padding material 23 between each of the individual parallel stitched seams and allow the spine 16 to curl flexibly such that it is easily cupped in the palm of the hand. The front leafboard 11 and the back leafboard fold about spine 16 to open and close the book cover.

Figure 3:
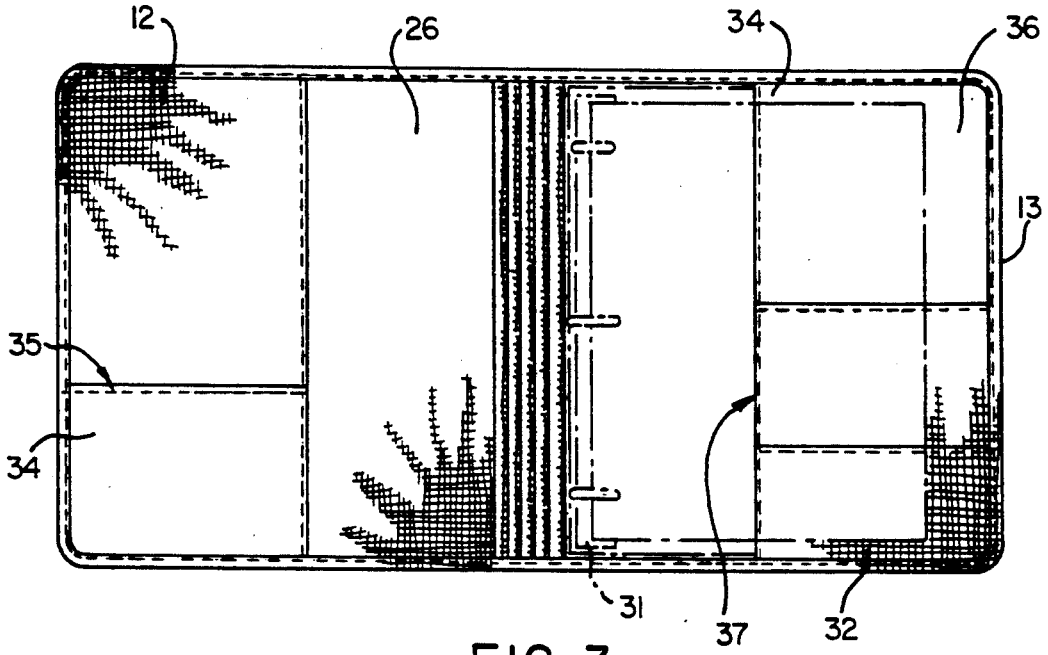
FIG. 3 is an overhead view of the inside surface of a book cover in accordance with the invention wherein the book cover is designed to retain a binder.
Figure 4:
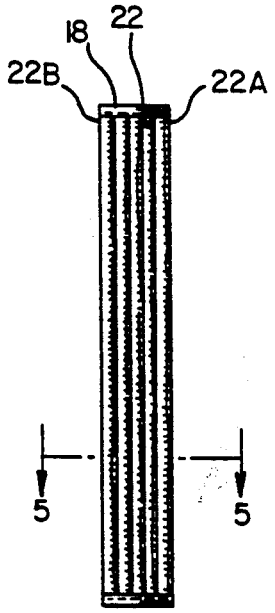
FIG. 4 is a frontal view of the spine member of the book cover in accordance with the invention.
Figure 7:
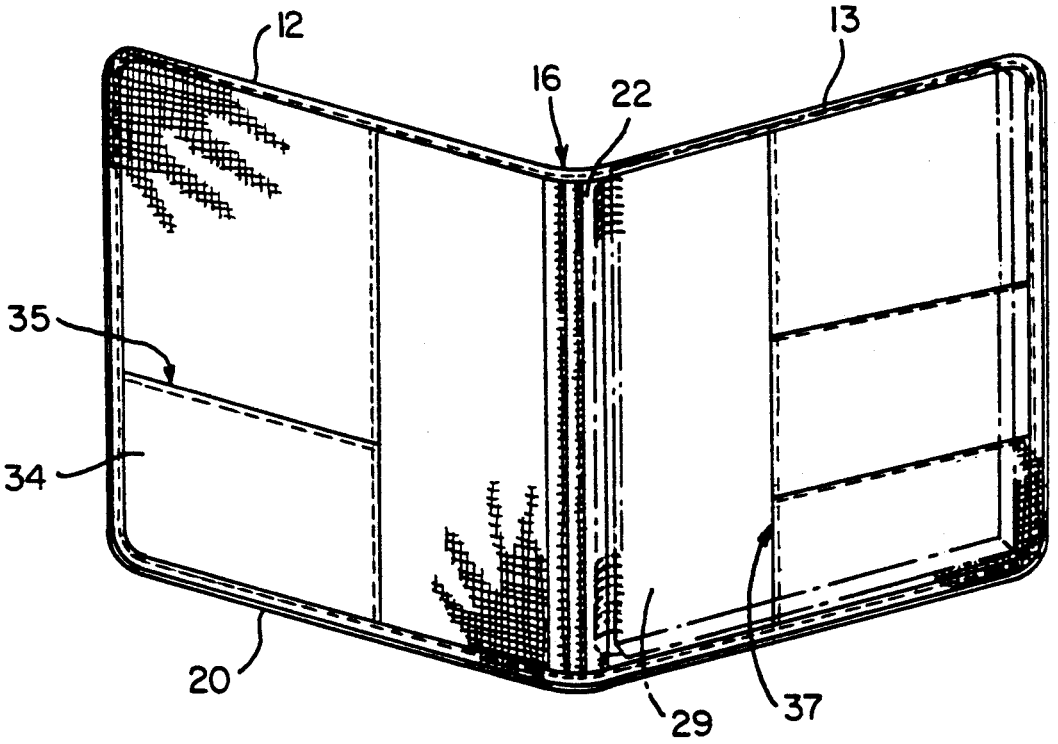
FIG. 7 is an overhead perspective view of the inside surface of a book cover adapted to receive a notebook.

The book cover 10 comprises at least one pocket 36 on either the front or back portion of the inside fabric surface 14. The pocket 36 is preferably longitudinal and made by stitching fabric material, which is similar to the fabric surface of the book cover, to the inside fabric surface 14 with an opening 37. The pocket 36 may be designed to receive and secure a portion of the front or back cover of a member 32 to be retained therein, such as a supporting board for a 3-ring binder member 31, as illustrated in FIG. 3 or a cover of a spiral notebook 29, as illustrated in FIG. 7. In a preferred embodiment, more than one pocket is created on the inside fabric surface 14. The additional pocket(s) 34 are created by stitching the fabric material, which is similar to the fabric surface of the book cover to the inside fabric surface 14 with a seam 35. The additional pocket(s) 34 vary in size and can be used for a variety of purposes, including, but not limited to, retain an additional notebook or to store additional supplies. In a more preferred embodiment, the additional pocket(s) 34 have a zipper or fastener stitched to its opening with a seam similar to seam 35 to keep the stored materials within.

Having described the invention in detail and by reference to preferred embodiments thereof, it will be apparent that modifications and variations are possible without departing from the scope of the invention defined in the appended claims.

What is claimed is:

1. A fabric covered book cover having an inside surface and outside surface and: consisting essentially of front and back rectangular leafboards and a spine, said leafboards being spaced from one another by said spine;

each of said leafboards including a stiffening member encased in a fabric member having a first portion corresponding to the outside of said book cover and a second portion corresponding to the inside of said book cover, said fabric member being woven nylon, said stiffening members being encased in said first and second portions of said fabric member by a seam at the periphery of said leafboards and a pair of internal seams running parallel to said spine and interposed between said spine and each of said leafboards about which internal seams said leafboards fold to open and close said book cover;

a padding member provided between said fabric member and said stiffening member on the outside surface of said leafboards;

a reinforcing woven nylon fabric border overlying said fabric member and fixed thereto by a peripheral seam at said periphery of said leafboards;

said spine including a plurality of spaced seams running the entire length of said spine and reinforcing said spine and enabling said spin to curl slightly and fit comfortably in the palm of the hand.

2. The book cover of claim 1 wherein said stiffening member is cardboard.

3. The book cover in claim 1 wherein said spin includes a padding member encased therein and said plurality of spaced parallel seams maintain said padding member in said spine and prevent said padding member from accumulating unevenly in said spine.

4. The leafboards of claim 1 wherein at least one pocket is provided on the inside surface of said front or back leafboards, and said pocket is adapted to receive a member to be retained in said cover.

5. The book cover of claim 4 wherein said cover additionally comprises a supporting board for a 3-ring binder received in a pocket of said cover.

6. The book cover of claim 4 wherein said cover additionally comprises a notebook received in a pocket of said cover.

* * * * *

UNITED STATES PATENT AND TRADEMARK OFFICE

CERTIFICATE OF CORRECTION

PATENT NO. : 5,219,437

DATED : June 15, 1993

INVENTOR(S) : Marc L. Moor and Jon R. Wyant

It is certified that error appears in the above-identified patent and that said Letters Patent is hereby corrected as shown below:

Claim 1: Column 4, Line 40, "spin" should be changed to --spine--

Claim 3: Column 4, Line 45, "spin" should be changed to --spine--

Signed and Sealed this

First Day of February, 1994

Bruce Lehman

*Attest:*

BRUCE LEHMAN

*Attesting Officer*

*Commissioner of Patents and Trademarks*